US005391083A

United States Patent [19]

Roebuck et al.

[11] Patent Number: 5,391,083

[45] Date of Patent: Feb. 21, 1995

[54] COMPUTER CARD CONNECTOR

[75] Inventors: Joseph V. Roebuck, Cupertino; Charles A. Centofante, Hollister; Rudolf Albrecht, San Jose; Henry A. Jupille, Placerville, all of Calif.

[73] Assignee: R. A. Tool & Die, Inc., Santa Clara, Calif.

[21] Appl. No.: 201,802

[22] Filed: Feb. 25, 1994

[51] Int. Cl.[6] ..... H01R 9/09

[52] U.S. Cl. ..... 439/76; 439/638; 439/350; 235/492

[58] Field of Search ..... 235/492; 361/736, 737, 361/746; 439/76, 344, 350, 351, 588, 638, 676

[56] References Cited

U.S. PATENT DOCUMENTS

| | | | |
|---|---|---|---|
| 4,463,999 | 8/1984 | Knickerbocker | 439/369 |
| 5,288,237 | 2/1994 | Mizutani et al. | 439/76 |
| 5,299,940 | 4/1994 | Uenaka et al. | 439/76 |
| 5,330,360 | 7/1994 | Marsh et al. | 439/76 |

*Primary Examiner*—Khiem Nguyen

*Attorney, Agent, or Firm*—Thomas E. Schatzel

[57] ABSTRACT

A computer card apparatus for interconnecting with and securely retaining a removable plug. The computer card's circuitry and components encapsuled within an insulating material, a sheet of metal superimposed over the insulating material and a plastic housing encompassing the sheet, insulating material, components and circuitry.

26 Claims, 2 Drawing Sheets

COMPUTER CARD CONNECTOR

BACKGROUND OF THE INVENTION

1. Field of the Invention

This invention relates generally to a means for securing interconnect plugs to computer boards. More particularly, but not by way of limitation, this invention relates to an apparatus for securely retaining a telecommunication jack through a connector to an external computer connector card.

2. Description of the Prior Art

Computers commonly include built-in slots for interconnecting with various printed circuit board attachments to enhance the computer's performance capabilities. Examples of various printed circuit board attachments include pagers, data modems, fax modems, hard drives, and network connectors. Currently there are several hundred different types of commercially available attachments for engagement with these computer slots. A popular computer board adaptor is the Personal Computer Memory Card International Association (PCMCIA) card. PCMCIA cards are approximately three-inch-by-two inch, approximately three-ten millimeters thick, and are readily insertable within the cabinets of personal computers.

The internal circuitry within PCMCIA cards vary depending on the desired functions to be accomplished. Advantages of these cards include their interchangeability, their adaption for easy external mounting to and connection with a computer, their small size and weight, and the transportability of such cards. In many instances, their size compares to that of ordinary playing cards. Part of these card's interchangeability enhancement features are derived from the vast majority of the telecommunication cards utilizing an "RJ-11" style telephone jack for interconnecting to external peripherals. The "RJ-11 jack is recognized world wide and is most likely the most widely used jack for connecting telephone lines with walls and computers, and is a telecommunication industry standard plug design.

However, the prior art lacks a means for readily interconnecting and removing a "RJ-11", "RJ-14," "RJ-45," or any other modular telephone jack style to and from these PCMCIA cards, while also providing a satisfactory means for securing such modular telephone jack style in place while it is desired to be interconnected.

Also, with such cards, it is necessary to provide for shielding from radio interferences. Currently, such shielding is provided by encasing such circuits in metal casings. Consequently, theses casings are relatively expensive and heavy in weight.

SUMMARY OF THE PRESENT INVENTION

It is therefore an object of the present invention to provide an interconnecting means for readily interconnecting and removing a hand removable plug to a personal computer board.

It is another object of the present invention to provide a means for securely holding a plug in place with a personal computer board during operation.

It is another object of the present invention to provide a means for securely holding a plug in place and allowing the plug to be readily removed without the need for any tools.

It is another object of the present invention to provide an interconnecting means for readily interconnecting a "RJ-11," "RJ-14," "RJ-45," or other modular telephone jack style to a personal computer card.

It is another object of the present invention to provide a means for securely holding a "RJ-11," "RJ-14," "RJ-45," or other modular telephone jack style in place with a personal computer card.

It is another object of the present invention to provide a means for securely holding a "RJ-11," "RJ-14," "RJ-45," or other modular telephone jack style in place and allowing the jack to be readily removable.

It is another object of the present invention to provide an economical, convenient, quick, and reliable structure for securing a plug with a connector card.

It is another object of the present invention to provide a pliable elastic structure for securely holding a plug in place with a personal computer card.

It is another object of the present invention to provide a pliable elastic structure for securely holding a plurality of plugs in place with a personal computer card.

It is another object of the present invention to provide a pliable elastic structure which includes an area where a manufacturer may insert commercial information readily visible by a user.

It is another object of the present invention to provide a personal computer memory card that may comprise an insulating housing while providing shielding.

It is another object of the present invention to provide a personal computer memory card that provides for lighter weight and more economical relative to computer memory cards heretofore available.

Briefly, a preferred embodiment of the present invention includes a computer card apparatus for interconnecting with and securely retaining a removable plug. The apparatus comprises a computer card for interconnection with a computer, a connector board with electrical connectors attached to the computer card and for receiving the removable plug, and an elastic boot including one end open for sliding the boot over the connector board and engaged plug, encircling the connector board, and securely interfacing with the removable plug engaged to the connector board. The computer card components and circuitry is encapsuled within an insulating material, a metal sheet superimposed over the insulating material, and a plastic housing encompassing the metal sheet and insulating material.

An advantage of the present invention is that it provides for an interconnecting means for connecting and removing a hand removable plug with a personal computer board.

Another advantage of the present invention is that it provides a means for securing a plug interconnected with a personal computer board during operation.

Another advantage of the present invention is that it provides a means for securely interconnecting a plug with a personal computer board and allowing for removal of the plug without the need of any tools.

Another advantage of the present invention is that it provides for an interconnecting means for connecting and removing a "RJ-11," "RJ-14," "RJ-45," or other modular telephone jack style with a personal computer board.

An advantage of the present invention is that it provides a means for securing a "RJ-11," "RJ-14," "RJ-45, " or other modular telephone jack style interconnected with a personal computer card.

Another advantage of the present invention is that it provides a means for securely interconnecting a "RJ-11," "RJ-14," "RJ-45," or other modular telephone jack style with a personal computer board and allowing the jack to be readily removable.

Another advantage of the present invention is that it provides an economical, convenient, quick, and reliable structure for securing a plug with a connector card.

Another advantage of the present invention is that it provides a pliable elastic structure for securing a plug with a computer card.

Another advantage of the present invention is that it provides a pliable elastic structure for securing a plurality of plugs with a computer card.

Another advantage of the present invention is that it provides a pliable elastic structure where a manufacturer may insert information readily visible for a viewer.

Another advantage of the present invention is that it provides a computer memory card that may comprise an insulating housing while providing shielding.

Another advantage of the present invention is that it provides a lighter and more economical personal computer memory card relative to personal computer memory cards heretofore available.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1:
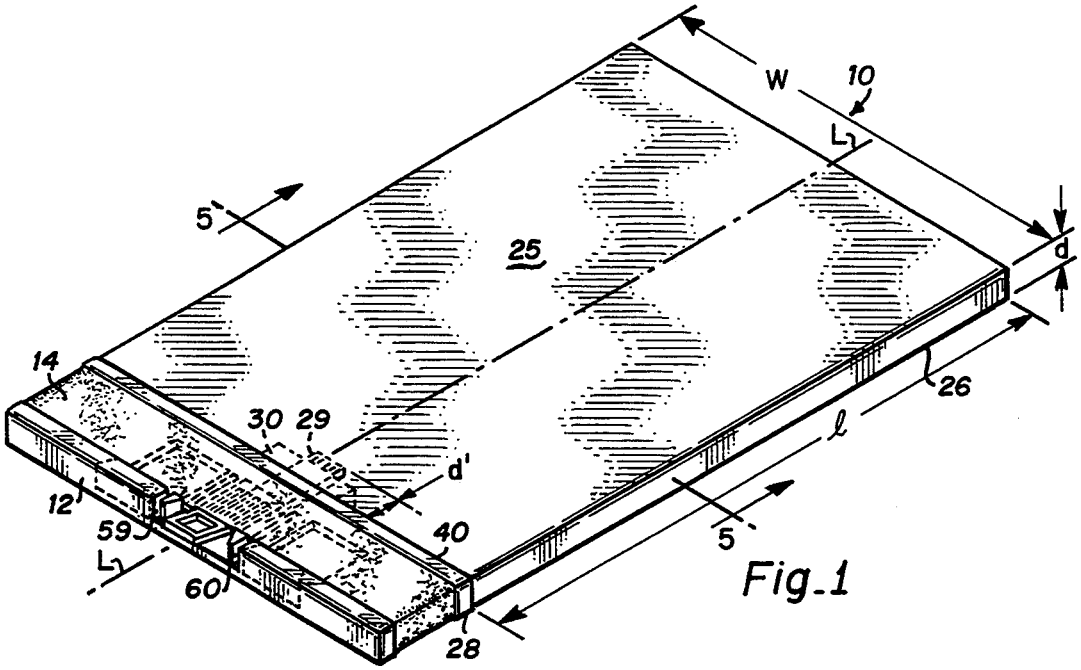
FIG. 1 is a perspective view of a PCMCIA card attached to a connector board with a boot surrounding the connector board pursuant to the present invention.

FIG. 1 shows a perspective view of a Personal Computer Memory Card International Association (PCMCIA) card 10, attached to a connector board 12, with a boot 14 wrapped around the connector board 12. The structure as shown in FIG. 1, illustrates the card 10 outside of a personal computer and free from connection to any peripheral products.

As illustrated in FIG. 1, the shape of the PCMCIA card 10 is rectangular and measures approximately two and three-fourths inches in length "l" approximately two inches in width "w", and a depth "d" ranging from approximately three and a third millimeters to ten millimeters tall. Currently, the three standard depths "d" of cards 10 are three and a third, five, and ten millimeters. The PCMCIA card 10 has a flat top wall 25 and bottom wall 26, and a rear face side 28 designed to receive and attach with terminals 29 of the connector board 12. The connector board 12 provides an interface connection between the circuit within the PCMCIA card 10 and external-devices. Included along a longitudinal axis "L" of the rear face side 28 is a rectangular cavity 30 of approximately three-fourths of an inch width, slightly shorter in height than that of the PCMCIA card 10, a depth "d'" for receipt of the terminal 29 of the connector board 12, and a shoulder 31 within the cavity 30. As assembled, the shoulder 31 slides within the cavity 30 and the terminals 29 interconnect with a female receptacle of the PCMCIA board 10.

Figure 2:
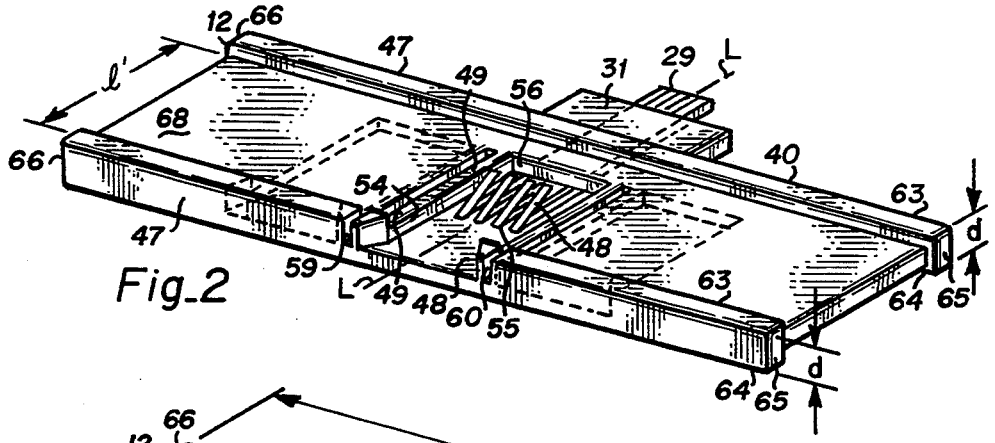
FIG. 2 is a perspective view of the connector board of FIG. 1.
Figure 4:
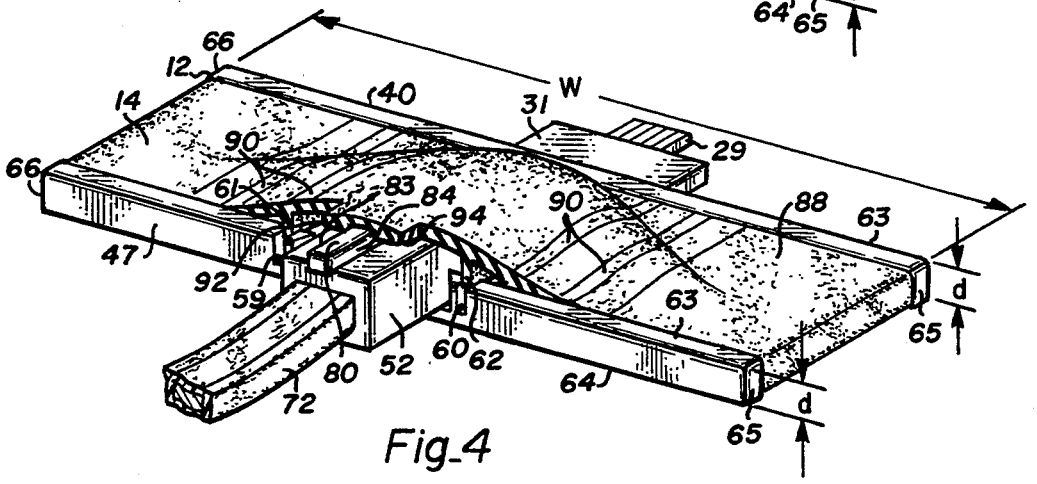
FIG. 4 is a perspective view of the boot securing a telephone jack connector with the connector board.
Figures 3, 5:
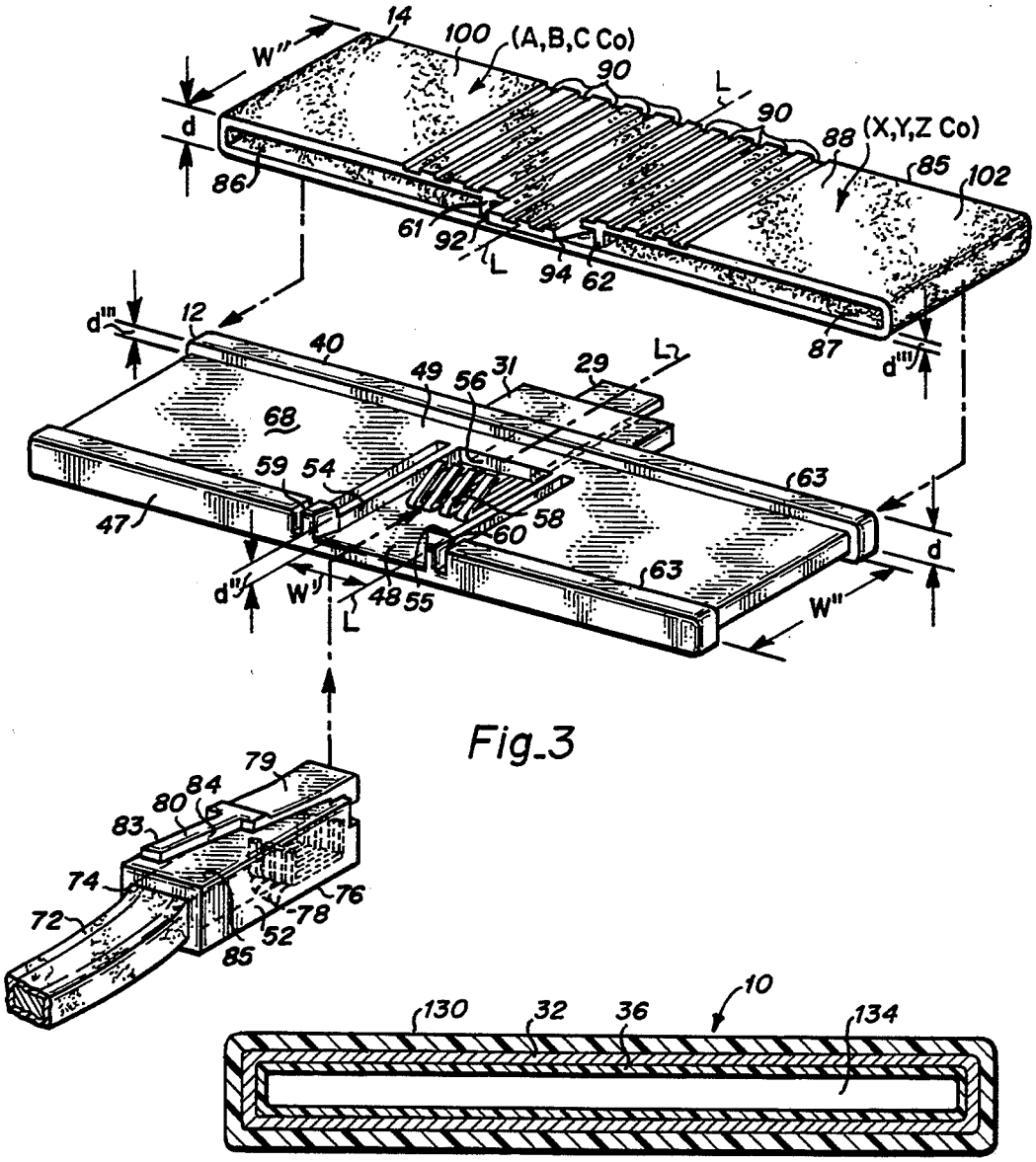
FIG. 3 is an exploded perspective view of the boot and the connector board of FIG. 1, and a telephone jack to be connected to the connector board.
FIG. 5 is a cross-sectional view of the PCMCIA card taken along the line 5—5 of FIG. 1.

FIGS. 2, 3, and 4 are perspective views of the connector board 12 illustrated in FIG. 1. A rear side wall 40 of the connector board 12 is of similar width "w" and depth "d" as the attached PCMCIA card 10, such that with the connector board 12 in place and abutting the card 10, the interface between the card 10 and connector board 12 is streamlined as illustrated in FIG. 1. A center area of the rear side 40 of the connector board 12 contains the shoulder 31 in the form of a rectangular section of dimensions slightly smaller than the dimensions of the rectangular cavity 30 in the attached PCMCIA card 10. The thin rectangular terminals 29 are connected and extend several millimeters perpendicular to the shoulder 31. The rectangular shoulder 31 and male terminals 29 are designed to slide within the rectangular cavity 30 of the attached PCMCIA card 10 to form a tight bind and electrical interconnection with terminals (not shown) of the board 10.

A front face side 47 of the connector board 12 contains similar exterior dimensions as the rear face side 28 of the PCMCIA card 10. Located along the longitudinal axis "L" of the front face side 47 is a channel 48 cut from a top surface 49 to approximately one half of the depth "d" of the front face side 47, of a width "w'" of approximately one-half an inch wide, and of a depth "d'" of three-eights of an inch. The channel 48 is designed for receipt of a connector jack 52. A pair of side walls 54 and 55 are tapered at the entrance of the channel 48 at approximately thirty degrees to allow for the connector jack 52 to readily slide smoothly into the channel 48. The length "l'" of the channel 48 extends to within approximately four millimeters of the rear side wall 40 of the connector board 12. Protruding from a rear channel wall 56 and towards the front face side 47 of the connector board 12, are several metallic J-shaped terminals 58. The terminals 58 are connected with the rectangular metal terminals 29 protruding from the rear side 40 of the connector board 12 and into the PCMCIA card 10. The purpose of the terminals 58 is to electrically unite the connector jack 52 with the PCMCIA board 12 so both the board 12 and the electrical terminals of the jack 52 can communication together. Except for the metal terminals 58, the connector board 12 is comprised of thermoplastic and/or thermoset.

About the front face side 47 of the connector board 14, and parallel with the lateral sides 54 and 55 of the channel 48, are a pair of notches 59 and 60. The notches 59 and 60 can vary in depth, width, and length. In FIGS. 1–5, the notches 59 and 60 are illustrated in the form of a channel, but can also be of a slot form. The purpose of the notches 59 and 60 are to receive a pair of segments of the boot 14 labeled a web 61 and 62. The channel is incorporated when the webs 61 and 62 do not extend from the top interior wall to the bottom interior wall of the boot 14. The notches 59 and 60 are a slot when the webs 61 and 62 do extend from the top interior wall of the boot 14 to the bottom interior wall of the boot 14.

About the rear face wall 40 and the front face wall 47, the connector board 12 has a pair of rims formed by a top wall 63, bottom wall 64, and two end sides 65 and 66 which are to a depth "d''''" of approximately one millimeter. These rims form a rectangular trough 68 which extends around the entire peripheral of the connector board 12. The trough 68 is shaped to receive the elastic boot 14 securely inside, and deters the boot 14 from laterally slipping off the connector board 12.

Although the connector board 12 can receive a variety of different types of connector jacks 52, such as a "RJ-14," "RJ-45," or other modular telephone jack style, a "RJ-11" style telephone jack is the most common (See FIGS. 4 and 5). The "RJ-11" jack 52 is approximately seven millimeters wide, seven millimeters high, and twelve millimeters long. An insulated wire 72 connects into a rear side 74 of the "RJ-11" jack 52, while a bottom wall 76 of the "RJ-11" jack 52 includes four parallel metal terminals 78 for connection with the J-shaped terminals 58 on the connector board 12. A pliant spring 79 of the "RJ-11" jack 52 includes an elongated release lever 80 with a pair of lateral sides 83 and 84 and which protrude at approximately a twenty degree angle from a top wall 85. The spring 79 is approximately five millimeters wide for eight millimeters and then narrows by one millimeter on each lateral side, and continues for another seven millimeters. Except for the insulated wire 72 connected with the four metal terminals 78, the preferred embodiment of the "RJ-11" style telephone jack 52 consists of a firm plastic which is only flexible at the spring 79.

The thickness of the material of the boot 14 is selected to coincide with the depth "d''''" of the trough 68. The width coincides with the width "w''''" of the trough 68. The length of the boot 14 is four inches to coincide with twice the width "w" of the connector board 12. The boot 14 forms a closed loop perpendicular to the longitudinal axis "L" and encircles the connector board 12. Thus, the boot 14 fits within the trough 68 and is comprised of a flexible elastic material such as neoprene, rubber, thermoplastic or thermoset material so it can expand and contract about the connector board 12 within the trough 68. The boot 14 contains a pair of open area walls 85 and 86 parallel to the rear wall 40 and face wall 47 of the connector board 12. Thus, the boot 14 can be stretched to slip over the front side 47 of the connector board 12 and then released and rest firmly within the trough 68. The boot 14, containing elastic qualities, interfaces with the connector jack 52, and binds it securely in place with the connector board 12.

A top wall 88 of the boot 14 can contain numerous lateral grooves 90 approximately fifteen to twenty thousands of an inch wide. These grooves 90 allow for expansion of the boot 14 over the release lever 80, and help form a snug fit as illustrated in FIG. 4. If there are several connector jacks 52 interconnected with the connector board 12, then their will be additional grooves 90 in the boot top 88.

Above channel 48, the boot top 88 extends forward for approximately two millimeters, coinciding with the width of the wall 63. Parallel with the lateral sides 54 and 55 of the channel 48, a pair of segments 92 and 94 of approximately two millimeters width, angle downward for approximately five millimeters and at approximately a twenty degree angle towards the connector board terminals 58. The two segments 92 and 94 are spaced apart a distance to form a slot for the release lever 80, and when in place to interface with and secure the top and lateral sides 83 and 84 of the release lever 80, as best shown in FIG. 4. These angled segments 92 and 94 assist the boot 14 in securing the connector jack 52 with the connector card 12.

Parallel with the pair of segments 92 and 94 are the pair of webs 61 and 62. The webs 61 and 62 are shaped to fit within the notches 59 and 60. The purpose of the webs 61 and 62 are to assist the boot 14 in securing the connector jack 52 with the connector card 12. The webs 61 and 62 being in the notches 59 and 60 establish lateral restraint on the boot 14. Thus, stretching of the boot 14 laterally beyond the notches 59 and 60 are restrained as the jack 52 is slid in place.

The taper of the walls 54 and 56 at the mouth of the entrance, assists insertion of the jack 52 in the channel 48. Also, the channel 48 may be of multiple widths depending on the number of terminals 58. Furthermore, there may be multiple channels 48 to receive multiple connectors 52. The number of channels 48 and terminals 58 will be dictated by the structure and function of the PCMCIA card 10. If there are multiple channels 48, laterally adjacent each channel will be notches 59 and 60 and the boot 12 will include webs 61 and 62 for each of said pair of channels. The boot 12 also lends itself for providing areas to receive commercial information. To the sides of the grooves 90 their are plateaus 100 and 101 on which a company may insert its' logo, commercial or instructional information.

FIG. 5 is a cross-sectional view of the PCMCIA card 10 of FIG.1 taken along the line 5—5 of FIG. 1. The PCMCIA card 10 is comprised of a hard plastic shell 130, enclosing a metallic layer 132 of material, which is separated from the components 134 of the PCMCIA Card 10 by a wall of insulated non-conductive material 136, such as paper or nylon. The purpose of the metallic layer 132 is to deflect any radio signal that the PCMCIA card 10 may omit, and thereby prevent interference with radio frequencies. The purpose of the insulating material 136 is to prevent the computer board components 134 from contacting the metallic blanket 132 and short-circuiting, while the plastic exterior 130 protects the PCMCIA components 134.

Current manufacturing methods produce the PCMCIA cards 10 with a thick metal shell. The above mentioned insulated material 136, metallic layer 132, and plastic shell 130 can be injection molded in one step, and therefore be less expensive to produce than currently available methods. Additionally, the three-layer PCMCIA card 10 design, PCMCIA circuit and component board 134, and the thermoplastic or thermoset connector board 12 can be combined in one dual density molding step, and therefore be produced faster, easier, and less expensively.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alterations and modifications as fall within the true spirit and scope of the invention.

We claim:

1. A personal computer card apparatus for interconnecting with and securely retaining a removable plug, comprising a computer card for interconnection within a personal computer;

a connector board with electrical connectors projecting from one end thereof for electrical engagement with the computer card and for receiving a removable plug;

an elastic boot encircling about said connector board and for interfacing with a removable plug engaged to said electrical connectors, the boot-having one end open for sliding said boot over said connector board and engaged plug; and whereby the elasticity of the boot causes an interfacing engagement of the boot with an attached removable plug to secure said plug in place.

2. The apparatus of claim 1 wherein the boot forms a closed loop about a longitudinal axis and a plurality of imprinted grooves on the top exterior surface of said boot and extending parallel to said longitudinal axis.

3. The apparatus of claim 2 wherein the boot further includes a top wall with a plurality of segments extending from an interior surface of said top wall and positioned to interface with said engaged plug to secure said plug in place.

4. The apparatus of claim 3 wherein said plurality of segments are comprised of a material harder than elastic.

5. The apparatus of claim 4 wherein said boot is comprised of an elastic material whereby said boot is under stress when in engagement with said plug.

6. The apparatus of claim 5 wherein the boot further includes a web extending from said interior surface of said top wall towards said interior surface of a bottom wall, positioned adjacent to and extending a similar depth as said engaged plug.

7. The apparatus of claim 2 wherein the connector board further includes a rear side wall for abutment with one end of said computer card, said rear side wall being of a length and height coinciding with a width and height side of said computer card, the connector board further including a front side wall with a channel for receiving said plug, and said channel including a metal connector means for mating engagement with terminals of said plug.

8. The apparatus of claim 7 wherein said channel includes walls tapered at an entrance.

9. The apparatus of claim 8 wherein said connectors means are of a J-shape.

10. The apparatus of claim 7 wherein the connector board further includes an incision within the top, bottom, and two lateral sides forming a continuous peripheral trough for receiving said boot and opposing lateral movement of the boot about the connector board.

11. The apparatus of claim 7 wherein the connector board further includes a front side wall with a notch for receiving a web.

12. The apparatus of claim 11 wherein the notch is a slot and the slot receives the web when the web extends from said boot top interior wall to said boot bottom interior wall.

13. The apparatus of claim 11 wherein the notch is a channel and the channel receives the web when the web is attached to the upper interior wall of the boot, but not to the bottom interior wall of the boot.

14. The apparatus of claim 10 wherein the connector board includes a plurality of said channels for receiving a plurality of said plugs and each of said channel including metal connector means for mating engagement with terminals of said plugs.

15. The apparatus of claim 14 wherein the connector board includes connector means of a J-shape for receiving and mating engagement with a "RJ-11," "RJ-14, " "RJ-45, " or any other modular telephone jack style.

16. The apparatus of claim 1 wherein the computer card encapsuled within an insulating material, a sheet of material metal superimposed over said insulating material and a plastic housing enclosing said sheet and insulating material.

17. The personal computer card apparatus for interconnecting with and securely retaining a removable plug comprising:

a personal computer memory card encapsulated in an insulating material about components and circuitry on a printed circuit board, a sheet of metal material over said insulating material to provide shielding to radio waves, and a protective shell of plastic material encompassing said insulating material and said metal material, said protective shell providing flat top and flat bottom surfaces to form a card insertable within a slot of a computer housing.

18. The apparatus of claim 17 wherein the cross-sectional configuration of the memory card is of a rectangular shape of a width "w" and a depth "d";

a connector board with electrical connectors projecting from one end of said board for mating electrical engagement with a terminal means within the memory card, said electrical connectors having a receptacle for receiving terminals of a removable electrical connector plug, the board having a rear face wall and a front face wall of a length equal to said width "w" and a height equal to said depth "d", said rear face being in abutment with one end of the memory card when said electrical connectors are mated with said terminal means of the memory card, said rear face wall and said front face wall being parallel with one another and spaced apart form a substantially rectangular shaped trough intermediate said rear face and said front face walls;

an elastic boot encircling about said connector board within said trough for interfacing with said removable electrical connector plug; whereby the elasticity of the boot causes ant interfacing engagement of the boot with an attached removable plug to secure said plug in place.

19. The apparatus of claim 18 wherein said trough has a width of w", and a depth of d'"; and the elastic boot has a width of w" and a thickness d'" whereby the boot rests within said trough.

20. The apparatus of claim 19 wherein the connector board includes a channel extending through said front face, a metal connector means within said channel and said trough for mating engagement with terminals of a plug.

21. The apparatus of claim 20 wherein the boot further includes a planar surface for receiving printed information.

22. The apparatus of claim 20 wherein the boot further includes a top wall with a plurality of segments extending from an interior surface of said top wall and positioned to interface with said engaged plug to secure said plug in place.

23. The apparatus of claim 22 wherein said plurality of segments are comprised of a material harder than elastic.

24. The apparatus of claim 22 wherein said boot is comprised of an elastic material whereby said boot is under stress when in engagement with said plug.

25. The apparatus of claim 24 wherein the connector board includes a notch extending adjacent to said channel, and the boot further includes a web extending from said interior surface of said top wall towards said interior surface of a bottom wall and positioned in alignment with and interfacing with said notch.

26. The apparatus of claim 24 wherein the connector board includes a pair of notches extending laterally adjacent each side of said channel; and the boot further includes a pair of webs extending from said interior surface of said top wall towards said interior surface of a bottom wall, and each of said webs being positioned in alignment with and interfacing with one of said notches.

* * * * *